United States Patent [19]

Salvucci

[11] Patent Number: 4,508,346

[45] Date of Patent: Apr. 2, 1985

[54] RANDOM NUMBER SELECTION METHOD AND APPARATUS

[76] Inventor: Lucio P. Salvucci, 746 Commercial St., Weymouth, Mass. 02189

[21] Appl. No.: 573,024

[22] Filed: Jan. 23, 1984

Related U.S. Application Data

[63] Continuation-in-part of Ser. No. 369,418, Apr. 19, 1982, abandoned, and a continuation-in-part of Ser. No. 462,426, Jan. 31, 1983, abandoned.

[51] Int. Cl.[3] ..... A63F 9/00

[52] U.S. Cl. ..... 273/144 B

[58] Field of Search ..... 273/144, 141 R, 142 H, 273/142 HA, 142 K, 138 R, 138 A

[56] References Cited

U.S. PATENT DOCUMENTS

| | | | |
|---|---|---|---|
| 1,994,977 | 3/1935 | Benson | 273/144 B |
| 2,001,366 | 5/1935 | Mittelman | 273/144 R |
| 2,185,366 | 1/1940 | Bartholomew | 273/144 B |
| 3,044,780 | 7/1962 | Silverman | 273/144 A |
| 4,185,828 | 1/1980 | Fernandez | 273/144 B X |
| 4,364,567 | 12/1982 | Goott | 273/144 B X |

FOREIGN PATENT DOCUMENTS

| | | | |
|---|---|---|---|
| 121801 | 12/1918 | United Kingdom | 273/144 B |

*Primary Examiner*—Paul E. Shapiro

*Attorney, Agent, or Firm*—Maurice R. Boiteau

[57] ABSTRACT

An apparatus and method for selecting random numbers, particularly suited for the purpose of placing wagers. The apparatus includes a funnel-shaped chamber from which balls are propelled by a stream of air from a motor driven fan beneath the chamber. The apparatus includes a transparent dome enclosing the chamber and a transparent, perforated tube into which the balls are propelled by the air and retained in the order of their arrival into the tube. The balls are numbered and distinctively colored for easy visibility and identification. An adjustably positionable finger enters the interior of the tube through one of the perforations to retain the pre-determined number of balls in the tube.

5 Claims, 7 Drawing Figures

RANDOM NUMBER SELECTION METHOD AND APPARATUS

The present application is a continuation-in-part of my prior applications for U.S. Letters Patent Ser. No. 369,418 and 462,426 filed respectively on Apr. 19, 1982 and Jan. 31, 1983, now abandoned.

The present application relates generally to improvements in apparatus and methods for selecting random numbers and more particularly to such apparatus and methods which are especially adapted to be used in selecting winners in lotteries or otherwise to be the subject upon which wagers are placed.

There are many conventional means and methods available for selecting random numbers upon which lotteries or wagers may be based. However, most conventional means and methods suffer from one or more deficiencies which frequently render them unfeasible and, more often, relatively impractical for many applications. An important deficiency encountered particularly in animal races and athletic contests is the generally high cost and space required. Another problem is that the event upon which the winner of wagers is determined consumes considerable time and accordingly limits the number of wagers which can be placed in a given time period. Some means and methods which appear suitable and expeditious upon casual examination, are, upon closer examination, found to be impractical because they do not afford protection against dishonest manipulation.

In terms of cost, space and time required for their operation horse and dog races are well known for providing the basis for determining the winners of lotteries or wagers. However, in spite of the requirements, such races are frequently known to be the objects of dishonest manipulations. Various dice games, wheels of fortune and roulette wheels have also been the means by which participants have been cheated. The result is that even when races and games of chance involving wheels and dice, are honest, the bettors are not convinced of their integrity. Essentially the same result obtains when numbers are chosen one at a time from one of various devices which deliver the number-bearing elements to the hand of an operator. The touching of the element by the operator provides an opportunity, real or apparent, for cheating.

It is accordingly a general object of the present invention to reduce both the actual and apparent opportunity for cheating in games of chance based on selections of random numbers.

Another object is to reduce the cost of the random number selection process for wagering purposes while maintaining a high degree of security against dishonest practices.

Still another object is to reduce the time between wagering opportunities based on randomly selected numbers or other indicia.

In the achievement of the foregoing objects, a feature of the invention relates to the combination, in the present apparatus, of a hopper and a vertical transparent display tube in which indicia-bearing balls are retained after having been selected. The bottom of the hopper is funnel shaped and is in communication with a motor driven fan which propels the balls in random manner, from the bottom of the hopper into the tube which is connected with a clear plastic dome sealed over the hopper. When the motor is energized to start a game, the balls are set in motion from their at rest positions in the bottom of the hopper, toward the entrance to the tube which presents a passage for air from the fan to the exterior of the dome. According to related features, the tube is formed with an end stop and a retainer for holding balls, which randomly enter the tube, in the order of their entry until released from the tube in preparation for the start of the next operating cycle or game. The tube, in accordance with another related feature is formed with a series of spaced-apart apertures through which air escapes carrying balls into the tube after the primary air passage offered by the end of the tube, has been partially blocked by balls entering and reaching higher positions in the tube.

The foregoing objects and features of the present invention will be more fully understood from the following detailed description of an illustrative embodiment taken in connection with the accompanying drawings in which.

Figure 1:
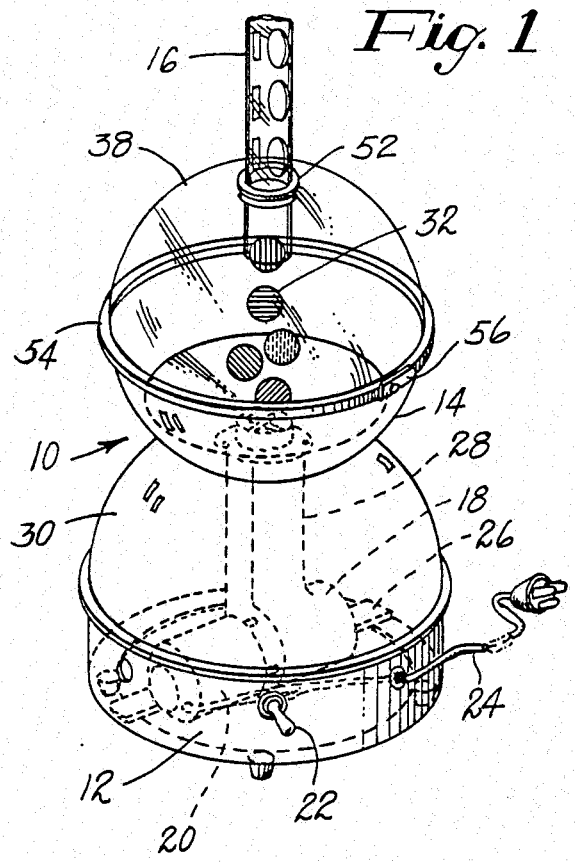
FIG. 1 is a view in perspective of an apparatus according to the present invention for randomly selecting and displaying numbers, including a plurality of indicia-bearing balls in motion during an operating cycle.
Figure 2:
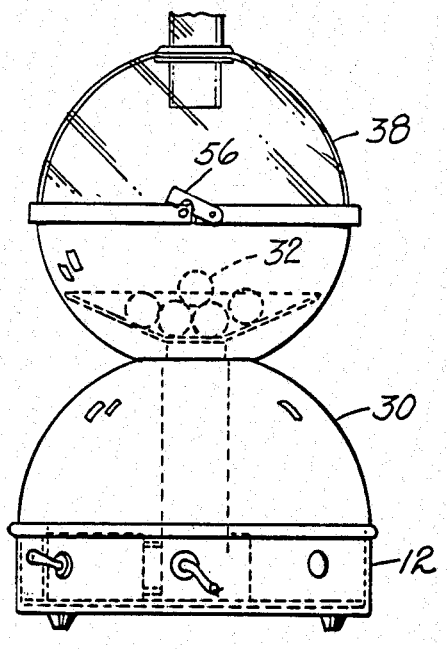
FIG. 2 is a view similar to FIG. 1 but showing the balls at rest between operating cycles.
Figure 4:
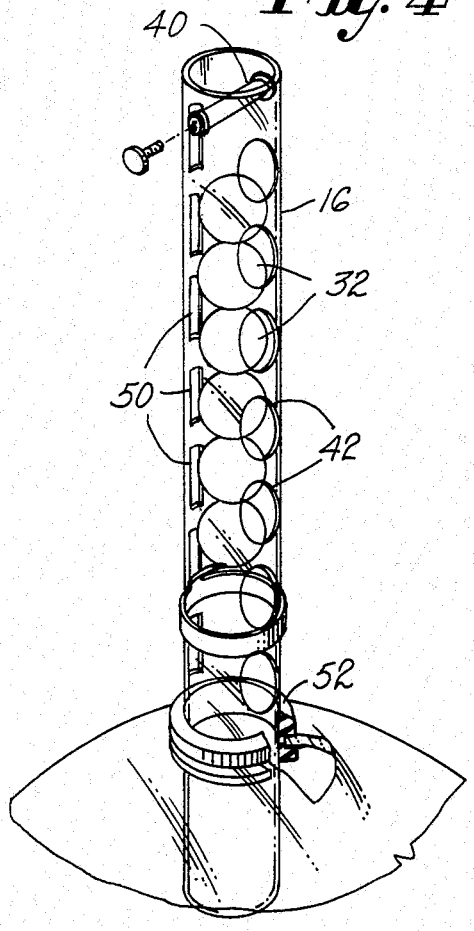
FIG. 4 is a fragmentary detail view depicting a display tube forming a part of the present apparatus.

Turning now to the drawings, there is shown, particularly in FIGS. 1 and 2 an apparatus indicated generally at 10 and comprising a base 12, a hopper 14 and a display tube 16. The base 12 supports a fan 18, driven by an electric motor 20 connected through a toggle switch 22 to a line cord 24. The fan 18 and the motor 20 are fixedly mounted on a plate 26 forming a part of the base 12 and the fan is in communication with the hopper through a conduit 28. A shell 30 is fixedly secured to the base 12 and encloses the fan 18 and the motor 20.

Figure 3:
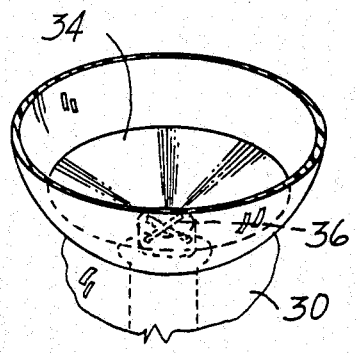
FIG. 3 is a detail view of a liner for a hopper forming a part of the apparatus of FIGS. 1 and 2.

At the start of a game or operating cycle, a set of balls 32 is resting at the bottom of the hopper 24 in a funnel shaped liner 34 having a lower end closed by a grate 36, as also seen in FIG. 3, so that the balls are prevented from entering the conduit 28 but air is allowed to pass through the grate to act upon the balls inside the chamber comprising the hopper 14 and a transparent dome 38. When the switch 22 is closed to energize the fan motor 20 and start the operating cycle of the apparatus, the balls 32 are blown randomly about the interior of the chamber in the general direction of the display tube whose upper end provides substantially the only outlet for air from the chamber. The balls are entrained by the air flow to enter the tube in a completely random order and, once in the tube, rise to the top up to a stop 40 which prevents the escape of the balls but allows air to pass. Balls entering the tube after the first ball rise to abut the first one. In the process, the succession of balls in the tube cuts off the flow of air through the top and would accordingly prevent the entry of successive balls after the first one. In order to prevent this occurrence, a series of spaced apart perforations 42, each smaller than the diameter of the balls, in the wall of the tube allows the continued flow of air to entrain further balls. The size and spacing of the perforations is a matter of experimentation, depending upon the amount of air flow, the size of the chamber, the relative size of the tube and balls and the density of the balls. It has been found effective to employ table tennis balls and to form the tube 16 of transparent plastic material having an interior diameter between ¼ and ½ inch greater than the diameter of the balls.

Figure 5:
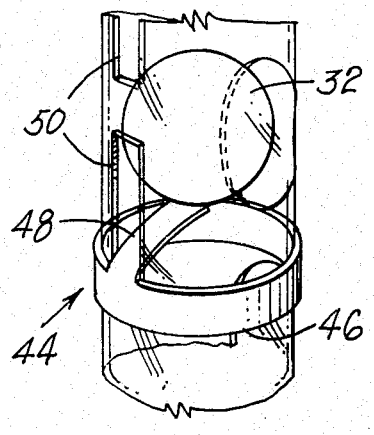
FIG. 5 is a fragmentary view on an enlarged scale showing a portion of the display tube and a device for retaining balls in the tube.
Figure 7:
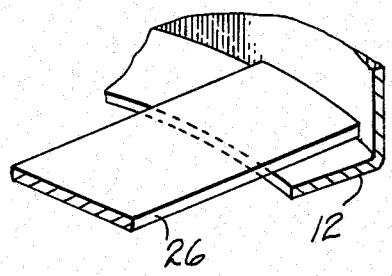
FIG. 7 is a detail view showing the construction of a base member forming a part of the present apparatus.
Figure 6:
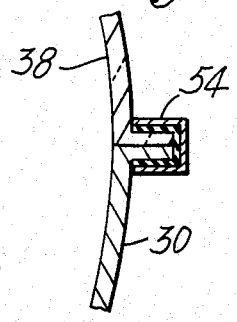
FIG. 6 is a detail view in vertical cross section depicting a connection between the hopper and a dome shaped cover.

For retaining the balls on display inside the tube after their entry, there is provided a keeper generally indicated at 44 in FIG. 5 and consisting of a garter section 46 which frictionally engages the exterior of the tube 16, and a barrier finger 48 which projects into the interior of the tube 16 through one of a series of spaced apart slots 50, to an extent sufficient to prevent the return of the balls toward the hopper. The keeper is made of a single relatively thin band of spring steel and the finger 48 is so shaped and flexible to be cammed out of the path of the balls 32 on their way up the tube but to support the light weight of the balls and thus retain them in the tube after their arrival and when the fan motor is switched off. The spacing of the slots is such that the number of balls to be retained in the display tube 16 during an operating cycle of the apparatus is determined by the slot through which the finger 48 projects into the interior of the tube. It is thus possible, with the present retainer arrangement, to select any number of balls during any operating cycle, from a single ball to a full complement, shown in the drawings to be eight. In preparation for each game, the balls in the tube 16 are released to the hopper by temporarily withdrawing the finger 48 from the interior of the tube.

The balls each bear a number and they are preferably color coded to present a clearer indication, at a distance, of the numbers which have been randomly selected and their order. It should also be realized that the number of balls placed in play in the hopper 14 may be substantially increased to accomodate to different games. In essence, the set of eight balls illustrated in the drawings provides opportunities for wagering in the same manner as would be available on one or more horse or dog races. The number of balls in play may also be somewhat increased to provide a greater number of potential combinations available to bettors.

The tube 16 is inserted a relatively short distance into the interior of the chamber, by passing through an opening in the dome 38, an annular gasket surrounding the tube to provide a partial seal which minimizes the escape of air between dome and tube. A band 54 of U-shaped cross-section having its ends joined together by a latch 56 interconnects integral flanges on the hopper 14 and the dome 38.

It will be appreciated from the foregoing description that the present invention fills a need in methods and apparatus for the selection of random number to become the subject of wagers of lotteries by assuring the security and honesty of the choice. It is particularly important that either during the operating cycle of the apparatus or between operating cycles, there is no contact with the indicia-bearing elements or balls by any interested party. This absence of contact greatly limits if it does not absolutely eliminate opportunities for a dishonest influence upon the selection.

From the foregoing description, many variations within the spirit of the present invention, will become immediately obvious to those of ordinary skill in the art. For example, the size of the balls may be varied or alternatively other equivalent indicia bearing elements may be introduced. It is accordingly not intended that this specification and the accompanying drawings be taken in a limiting sense but rather that the scope of the invention be interpreted from the appended claims.

Having thus disclosed my invention, what I claim as new and desire to secure by Letters Patent of the United States is:

1. Apparatus for selecting and displaying random indicia comprising means defining a chamber, a plurality of elements adapted to be introduced into the chamber and each bearing one of the indicia, an open-ended vertical tube slightly larger than the elements, formed with a series of spaced apart perforations through its wall and in communication with the upper end of the chamber, means in communication with the lower end of the chamber for causing air to impinge upon the elements and entrain them into the tube, and releasable means for retaining at least one of the elements in the tube.

2. Apparatus according to claim 1 further characterized in that the elements are relatively lightweight balls each having an individual color and each bearing a number associated with the color.

3. Apparatus according to claim 2 further characterized in that the tube is formed with a plurality of close-ended slots extending through its wall and spaced along the length of the tube, and in that the releasable means comprises a retainer frictionally engaging the exterior of the tube and including a finger selectively insertable into the interior of the tube through one of the slots for retaining a pre-determined number of balls in the tube during an operating cycle of the apparatus.

4. A method of selecting random numbers comprising the steps of placing a plurality of balls each bearing a number into a partially closed container, placing a supply of air in communication with the balls in the container, providing an open-ended display tube in communication with the container, causing air from the supply to impinge upon the balls to entrain a plurality of them into the tube in a random order, allowing a major portion of the air from the supply to escape from the interior of the tube in an intermediate zone after a first ball has entered the tube and risen to restrict air flow through the open end and retaining at least some of the balls in the tube in the order in which they entered.

5. A method according to claim 4 further comprising the step of releasing the balls from the tube after the display has been seen.

* * * * *